US005415037A

United States Patent [19]

Griston et al.

[11] Patent Number: 5,415,037

[45] Date of Patent: May 16, 1995

[54] METHOD AND APPARATUS FOR MONITORING DOWNHOLE TEMPERATURES

[75] Inventors: Suzanne Griston, Bakersfield; John Crowe, Brea; Barry A. Reik, Fullerton, all of Calif.

[73] Assignee: Chevron Research and Technology Company, San Francisco, Calif.

[21] Appl. No.: 985,773

[22] Filed: Dec. 4, 1992

[51] Int. Cl.[6] ..... E21B 47/06

[52] U.S. Cl. ..... 73/154

[58] Field of Search ..... 73/152, 154; 374/136, 374/137, 29

[56] References Cited

U.S. PATENT DOCUMENTS

| | | | |
|---|---|---|---|
| 3,668,927 | 6/1972 | Howell et al. | 73/154 |
| 3,808,889 | 5/1974 | Rawson et al. | 73/154 |
| 3,874,232 | 4/1975 | Hardison | 73/154 |
| 4,779,994 | 10/1988 | Diller et al. | 374/29 |
| 4,811,598 | 3/1989 | Dillier et al. | 73/154 |
| 4,881,406 | 11/1989 | Coury | 73/154 |
| 5,121,993 | 6/1992 | Carrigan et al. | 73/154 |

FOREIGN PATENT DOCUMENTS

| | | | |
|---|---|---|---|
| 0135746 | 5/1979 | Germany | 374/29 |
| 0285892 | 11/1984 | Japan | 374/29 |

*Primary Examiner*—Hezron E. Williams
*Assistant Examiner*—Michael J. Brock
*Attorney, Agent, or Firm*—M. W. Carson

[57] ABSTRACT

A method and apparatus for determining the temperature in a wellbore is disclosed. The apparatus is lowered into a wellbore to a desired depth and logged over a selected interval. At least one first heat flux and temperature sensor contacts the wellbore wall. At least one second heat flux and temperature sensor is maintained in contact with the drilling fluid. Comparison of sensor responses provides an accurate determination of the wellbore wall temperature, and a determination of the quality of sensor-wellbore wall contact.

12 Claims, 5 Drawing Sheets

MEASUREMENTS RELATIVE TO TOOL ZERO
ALL LENGTHS IN FEET $$\text{TIME CONSTANT} = \tau = \frac{\rho V c}{h A} = \frac{\text{THERMAL CAPACITANCE OF SENSOR}}{\text{THERMAL CONDUCTANCE OF FILM}}$$

METHOD AND APPARATUS FOR MONITORING DOWNHOLE TEMPERATURES

FIELD OF THE INVENTION

This invention relates generally to determining the temperature in a wellbore. More specifically, this invention provides a heat flux and temperature sensor that contacts the geologic formations, and a second heat flux and temperature sensor that is maintained in contact with the drilling fluid.

BACKGROUND OF THE INVENTION

There has been a need for a reliable, fast, economic, and accurate method for monitoring the temperature in a wellbore for many years. Comprehensive geologic reservoir characterization (or formation evaluation) and monitoring studies require that various logging measurements be obtained in open and cased wellbores under thermally transient and/or steady-state conditions. Wellbore temperature measurements are an integral part of these studies. For example, time-lapse cased-hole temperature profiles are used in steamflood monitoring programs to determine areal and vertical sweep of steam, identify heated or cooled zones within a reservoir, and to determine reservoir heating rate, heat loss to surrounding strata, barriers to vertical flow, and steam zone pressure. In addition, time-lapse open hole temperature measurements are used in sedimentary basin hydrocarbon maturation studies to establish the time and locations at which hydrocarbon generation occurred and to identify depth limits to occurrences of commercial hydrocarbon reservoirs.

Various logging measurements such as resistivity, dielectric, carbon/oxygen, and pulsed neutron capture are sensitive to wellbore and near-wellbore temperature changes. These temperature changes can occur both spatially (i.e., radial or longitudinal temperature gradients) and temporally (e.g., under transient conditions). The significance of these effects depends on the time response characteristics and depth of investigation of the tools as well as the magnitude of the temperature changes. Consequently, resulting reservoir porosity and fluid identification data can be extremely difficult to interpret without accurate knowledge about wellbore and reservoir temperature changes that occur during the logging process. In order to minimize potential project development risks and maximize reservoir management efficiency (e.g., evaluating reservoir characteristics, monitoring reservoir performance, and optimizing operating strategies), wellbore temperatures must be included in the evaluation and interpretation of these data.

Ideally, wellbore temperature measurements are often assumed to closely represent the true formation or reservoir temperatures. In reality, however, the measurement of transient and steady-state wellbore temperatures and the extrapolation of these measurements to steady-state reservoir temperatures can be a complicated process. For example, open-hole temperature measurements are affected by large radial gradients resulting from the heating or cooling of the wellbore and surrounding reservoir by circulating drilling mud. Steady-state wellbore and reservoir temperatures can be estimated using wellbore heat transport models to extrapolate transient temperature measurements obtained during and immediately following the drilling process. However, studies show that the resulting steady-state temperature estimates are very sensitive to the accuracy of the transient wellbore measurements.

Similarly, cased-hole temperature measurements are affected by transient conditions caused by wellbore cooling and heating processes associated with cyclic fluid injection and production. In steamflooded reservoirs, steady-state wellbore temperatures can change rapidly from one depth location to another, resulting in steep thermal gradients inside the wellbore. In such cases, natural convection of wellbore fluids can significantly alter or "smear" cased-hole temperature profiles from true reservoir values. These smeared profiles can be corrected using wellbore heat transfer models in conjunction with heat flux measurements. The reliability of the corrected temperature profiles are, of course, dependent upon the accuracy of the initial "uncorrected" temperature profile measurements.

In general, fast responding temperature logging tools are crucial to obtaining reliable and accurate temperature measurements, for either open or cased-hole wells. Unfortunately, because of thermal inertia, temperature logging tools do not respond instantly to changes in environmental temperature. Instead, existing temperature logging tools are known to respond in a transient manner. The rate at which the tool reaches thermal equilibrium with its surrounding environment depends on many factors such as tool design, wellbore fluid, magnitude of the temperature change to which it is exposed, logging speed, and sensor design. Consequently, running temperature logs at a continuous speed, or with insufficient stationary time intervals can cause the tool to "thermally lag" behind the actual wellbore temperature changes.

Existing temperature logging tools are typically designed to monitor the operating temperature of other wireline logging tools for equipment diagnostic purposes. For example, maximum recording thermometers are attached to a suite of tools to monitor the highest temperatures they encounter during logging. More recently, Schlumberger TM has developed an Auxiliary Measurement Sonde (AMS) tool for continuously monitoring the tool temperatures during logging. Unfortunately, these temperature monitoring devices are incorporated into massive wireline sondes which are designed to prevent rapid heating or cooling of electronic components. Consequently, the temperature tools have large thermal time constants preventing quick response to wellbore temperature changes.

U.S. Pat. No. 4,811,598 (assigned to Applicant's assignee and hereby incorporated by reference) teaches a wall-contact temperature tool that improves thermal response characteristics in cased-hole wells. A relatively fast responding temperature sensor, such as a thermocouple or resistance temperature detector (RTD) or thermistor is mounted on the surface of a bow-spring centralizer, which is attached to a standard wireline logging sonde.

The method used to physically attach the temperature sensor to a bow spring or side-arm caliper has a direct impact on response time, as does the overall mass of the tool (see S. Griston, "Fluid Effects in Temperature Observation Wells", SPE Paper No. 19740, presented at the 64th Annual Technical Conference, San Antonio, Tex., Oct. 8–11, 1989). In addition, if the sensor is caliper mounted, the overall temperature response depends upon how effectively the sensor makes contact with the wellbore wall. It is therefore desirable to develop a method and apparatus to establish a reliable means of monitoring sensor contact quality.

In the wireline logging industry, it is typically assumed that wall-contact tools (including resistivity and nuclear tools) maintain complete sensor contact with the wellbore wall throughout the logging process. However, field data suggest that in rugose wellbores (often encountered during open-hole logging), both bow-spring and caliper-arm mounted temperature sensors do not consistently make complete contact with the wellbore wall. Consequently, the accuracy and reliability of the resulting measurements (which include wellbore temperature) are considerably degraded.

There are currently no adequate methods for determining the degree of contact between the sensor and the wellbore wall. Present log interpretation methods ignore the possibility of poor contact, unless it is an extreme case, such as in situations where there is a large washout. However, field data show that temperature response is highly correlatable with wellbore rugosity (the change in wellbore diameter with depth). It is also true that the response of a heat flux sensor will be highly sensitive to borehole wall contact since the sensor is specifically designed to measure heat flow through a surface.

None of the existing methods utilize a heat flux sensor in combination with a temperature sensor to correct for the effects of thermal inertia and tool response time, wellbore fluids, and inconsistent wall-contact effectiveness.

Prior work that discloses the use of downhole temperature sensors yet does not compare measurements of heat flux and temperature sensors that contact the wellbore wall with measurement of heat flux and temperature sensors that are kept in contact with drilling fluid include U.S. Pat. No. 3,981,187; U.S. Pat. No. 4,578,785; U.S. Pat. No. 4,109,717; U.S. Pat. No. 3,014,529; Soviet Patent No. 0156,504; Soviet Patent No. 0732,515; and French Patent No. 1,165,791.

Therefore, there is still a need for an improved, reliable, fast, economic, and accurate method and apparatus for monitoring the temperature in a wellbore that corrects for the effects of tool and sensor response time, wellbore fluid, and inconsistent wall-contact effectiveness.

SUMMARY OF THE INVENTION

A method and apparatus for monitoring the temperature in a wellbore is disclosed. The apparatus is lowered into a wellbore to a desired depth and raised or lowered over a selected interval. At least one first heat flux sensor and temperature sensor is attached to a means for contacting the sensor against the wellbore wall. At least one second heat flux sensor and temperature sensor is maintained in contact with the drilling fluid in the wellbore, while not contacting the wellbore wall. The diameter of the wellbore is determined.

It is one object of the invention to record the responses of the first and second sensors, to permit a comparison thereof.

It is another object of the invention to determine when the first sensor was in contact with the wellbore wall, from the comparison of the sensor measurements. A thermal time constant can be ascertained, and it can be determined whether and when the first and second sensors are in thermal equilibrium.

DETAILED DESCRIPTION OF THE INVENTION

The present invention overcomes existing difficulties associated with the measurement, monitoring, and interpretation of temperatures in a wellbore.

Various conventional logging tools that measure data such as resistivity, dielectric constant, carbon/oxygen ratio, neutron porosity, and pulsed neutron capture are known to be sensitive to wellbore and near-wellbore temperature changes.

The present invention provides a reliable, accurate and economic means to determine such wellbore temperatures.

Figure 1:
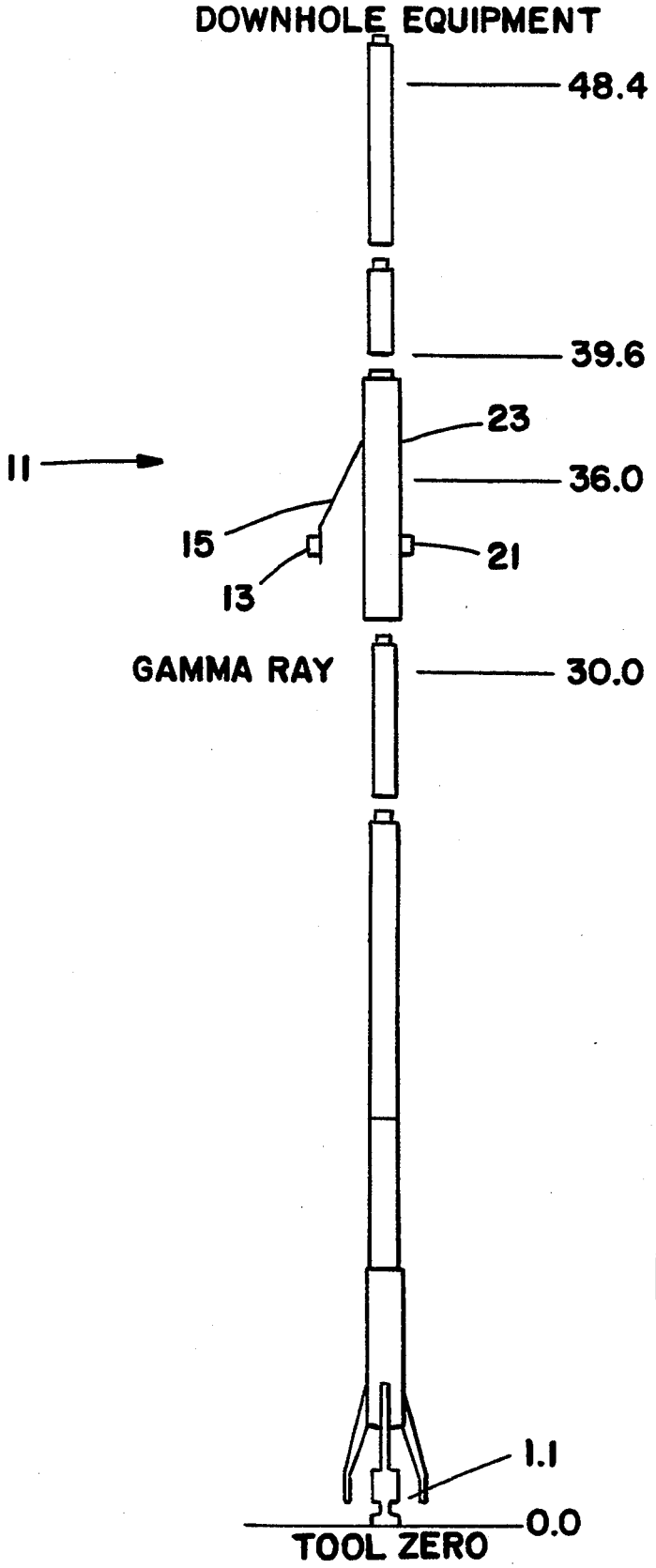
FIG. 1 is a schematic, sectional view of the inventive temperature tool.

Referring to the drawings, FIG. 1 is a schematic, sectional view of the inventive apparatus, 11. Any downhole wireline logging tool may be part of the apparatus. Resistivity tools, electron density tools, dielectric phase and amplitude tools, isotope ratio measurement tools, and pulsed neutron capture tools are especially useful. In one embodiment, the inventive apparatus (hereinafter referred to as a "temperature tool") exists as a stand-alone tool.

A first heat flux (or heat flow) and temperature sensor 13 is attached to a means for contacting the sensor against the wall of a wellbore. The term "contacting" is hereby defined to mean thermal contact, and the sensor need not actually touch the geologic formation. The sensor 13 could also be disposed on the inside of the contacting means, provided that heat flux could be effectively measured. Caliper-arm 15 is a well-known means of contacting a wellbore wall, as a tool is lowered and then raised in a wellbore. In another embodiment of the invention, a bow-spring centralizer may also be used to contact the sensor 13 against the wellbore wall. If the wellbore is deviated from vertical, such as with a horizontal well, the first sensor 13 may be mounted on the temperature tool face to provide contact with the wellbore wall. Any means known in the art may be used to attach the sensor to the contacting means. Studs with a shim steel backing is an especially useful attaching means.

Heat flux (or heat flow) sensors are well known. Rdf Corporation TM, for example, makes such a sensor. It is desirable that the heat flux sensor be of sufficiently small size to fit on the contacting means 15. Heat flux measurements (q) are a determination of change in heat flow through a known area over a selected time interval. Heat flux is frequently listed in btu/hr/ft$^2$, or watts/m$^2$.

Temperature sensors are well known, and downhole thermometers are well known in the well logging art.

Figure 2:
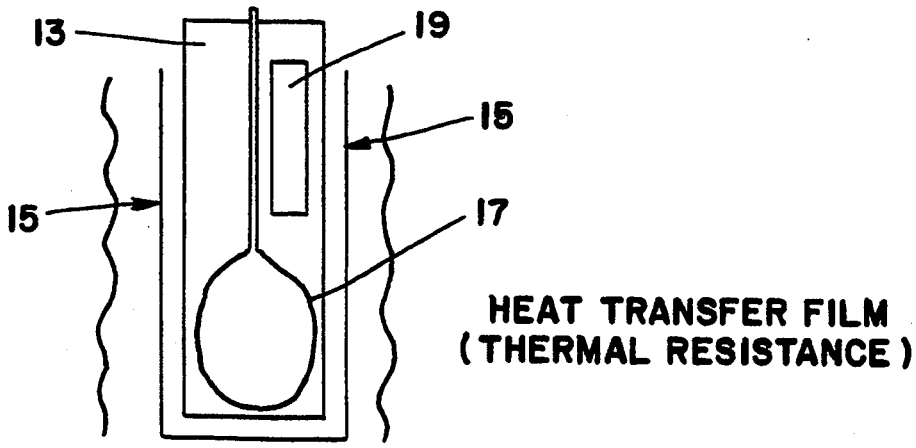
FIG. 2 is a schematic view of the side of the contacting means and first sensor that contacts the wellbore wall.

An especially useful temperature sensor is a platinum resistance thermometer surface sensor, having a response time of less than one minute, typically on the order of seconds, having a thickness of less than 0.05 inches, and coated with a polymeric insulator, such as polyimide. Other temperature sensors include thermocouples, resistance temperature detectors (RTD) and thermistors. A first heat flux sensor 17 and a first temperature sensor 19, together attached to a contacting means 15 are hereinafter referred to as "first heat flux and temperature sensor" 13, as shown in FIG. 2. FIG. 2 is a schematic view of the side of contacting means 15 and first sensor 13 that contacts the wellbore wall during logging.

A second heat flux and temperature sensor 21 is maintained in contact with the drilling fluid in the wellbore, and is disposed in a manner such that the second sensor 21 does not contact the wellbore wall. As shown in FIG. 1, in the preferred embodiment, the second heat flux and temperature sensor 21 is attached to the temperature tool face 23, at a position along the tool that is nearly opposite to the position of the first sensor, on the apparatus, so as to minimize any heat flux or temperature measurement discrepancies resulting from the two sensors recording measurements from different depths in the wellbore. The second heat flux and temperature sensor is nearly identical to the first sensor in the preferred embodiment, and can be attached in the same manner, although different types of heat flux sensors and temperature sensors could be used.

For thermally stable borehole environments, such as observation wells, the temperature tool 11 is lowered to a selected depth and raised or lowered (logged) over a selected interval. If the thermal constant of the temperature tool is precisely known, then the measurement error for transient temperatures as a function of logging speed can be determined, and a preferred logging speed can be selected. The inventive temperature tool can be designed to permit logging speeds at relatively fast rates of one to two feet per second (or faster), with continuous surface monitoring. Therefore, in another embodiment of the invention, more than one first heat flux and temperature sensors 13 and more than one second heat flux and temperature sensors 21 are attached to the tool. The mounting of multiple heat flux sensors allow the monitoring of the thermal state of the tool itself during operation. For example, the multiple sensors can be used to determine if the tool is in thermal equilibrium with the drilling fluid (or mud column) at any time during the logging process. This can be accomplished by monitoring the flux of heat through the surface of the sensor or logging tool into the mud column. If these fluxes are negligible, the sensor or logging tool is essentially in thermal equilibrium with the mud column. An application of this determination is the controlling of the sensor logging speed so as to minimize the thermal lag of the tool. In another embodiment of the invention, the multiple sensors permit the determination of the thermal response characteristics of the temperature tool in-situ.

Figure 4:
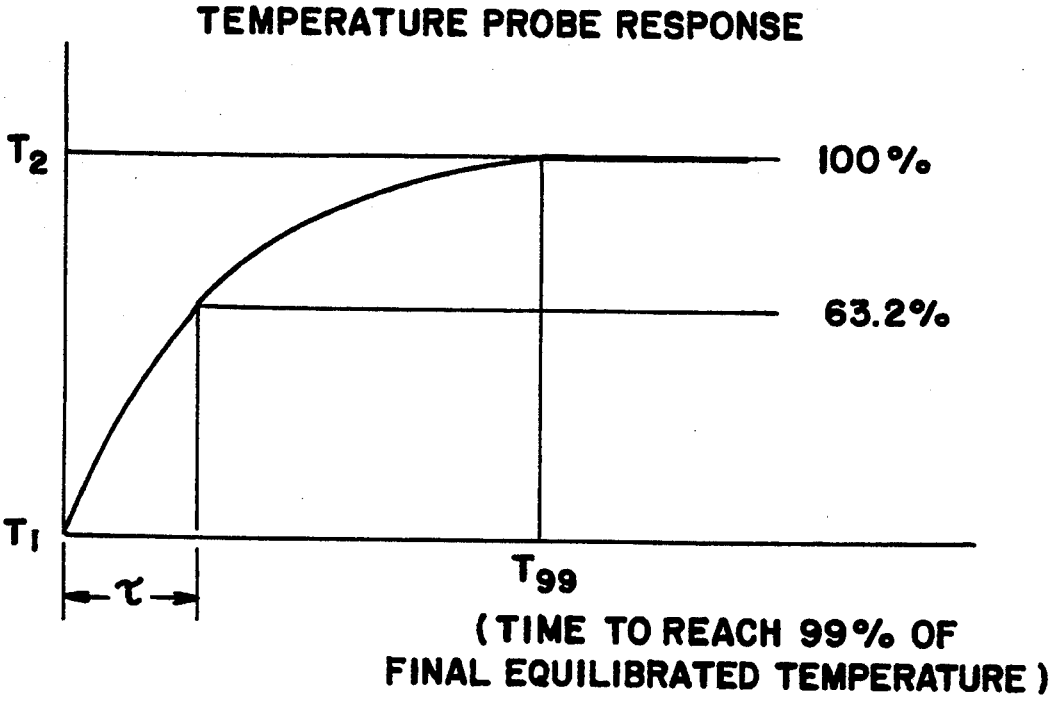
FIG. 4 illustrates the transient manner of temperature sensor response due to thermal inertia.

This can be done by monitoring the rate at which the sensor or logging tool heats up or cools down using the heat flux sensors and by applying the physical relationship between thermal time constant $\tau$ and the observed heating/cooling data illustrated in FIG. 4.

The inventive temperature tool and method for the use thereof, further comprises a means for determining the diameter of the wellbore, to enable a determination of when the first heat flow and temperature sensor is in contact with the wellbore wall. A caliper-arm is an especially useful means for determining wellbore diameter, and are well known in the well logging art.

In another embodiment of the invention, a means for recording the response of the first and second heat flux and temperature sensors is provided, to enable a comparison of the measured sensor responses. Such recording means are known in the art.

Accuracy of wellbore rugosity (the change in wellbore surface irregularity with depth) determinations can be greatly increased by improving the ability to monitor wellbore wall contact. In yet another embodiment of the invention, the quality of wellbore wall contact can be monitored by recording and comparing the responses of the first and second heat flux and temperature sensors. The first heat flow sensor 13 is biased to contact the wellbore wall, and the second sensor 21 is kept in contact with the borehole fluid (often drilling mud) as a reference. During logging operations, when poor or no contact of the first sensor 13 with the wellbore wall occurs, such poor or non-contact will be determined by comparing the measurements of the first and second sensors. As temperature is measured along with heat flux, the heat flux measurements provide a means for quality control for the reliability of the temperature measurement. Response time of the heat flux sensors is fast enough to detect the effects of borehole rugosity on a scale not possible with conventional caliper-arm measurements. The heat flux sensors measure heat flow through a surface area. They are, therefore, extremely sensitive to contact or lack of contact between the sensor and the borehole wall. In a rugose situation, the heat flux sensor will indicate the presence of rugosity on a scale significantly below that of a conventional caliper measurement (calipers are sensitive to rugose condition on the order of the caliper pad dimensions, the heat flux sensor is sensitive to rugose conditions on the order of the sensor dimension).

The means for electrically connecting the heat flux and temperature sensors to the temperature tool 11 are well known in the well logging art. In one embodiment, the temperature sensors are each connected to a lead wire having a four-wire configuration, wherein two wires are for temperature measurement and two wires are for wire resistance connection. It is desirable that the lead wire has stranded copper conductors and is insulated with a polymeric material, such as polyimide. Connected to the lead wire is an armored electric wire line, which is connected to a means for measuring the resistance of the temperature sensor, correcting for the resistance of the lead wire, and converting the resistance value to a temperature. The remaining temperature electronics can remain at the surface.

Testing has demonstrated that existing contact temperature tool measurements do not follow ideal response time behavior, defined as $$\text{time constant} = \tau = \frac{\rho V c}{hA}, \text{ measured in hours,}$$

where $\rho$=density of the tool (lb/ft$^3$ or kg/m$^3$)

V=tool volume (ft$^3$ or m$^3$)

c=specific heat capacity of the tool (Btu/lb-° F. or J/kg-° C.)

h=heat transfer coefficient of the fluid surrounding the tool (Btu/ft$^2$-hr-° F. or watts/m$^2$-° C.)

A=surface area of the tool through which heat is transferred (ft$^2$ or m$^2$)

Instead, response time for a temperature sensor contacting a wellbore wall is highly dependent upon the method used to mount the sensor onto a contacting means such as a bow-spring, and whether or not the tool makes complete contact with the wellbore wall.

Figure 3:
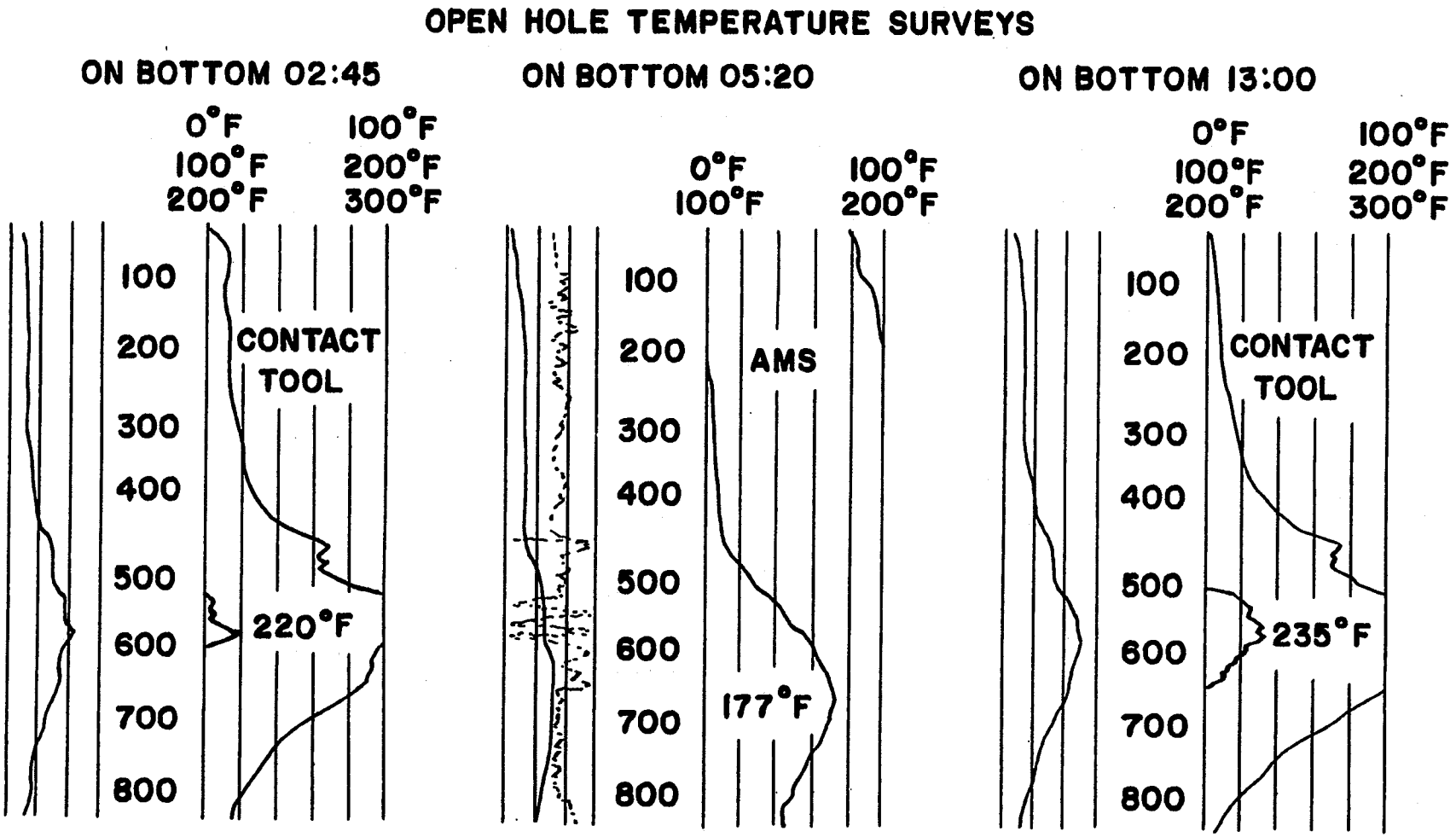
FIG. 3 illustrates a comparison of temperature profiles recorded in a wellbore using a wall-contact tool and a non-contacting tool.

Field testing has demonstrated the importance of a wall-contacting tool. FIG. 3 is a well log that illustrates a comparison of temperature profiles recorded from a well in Kern River Field, Kern County, Calif., using a wall-contact tool and a non-contacting tool (the Schlumberger TM Auxiliary Measurement Sonde (AMS).

The profiles, measured over an 11-hour period, show steamflood temperatures of 220° F.@0245 hours (contact tool), 177° F.@0520 hours (AMS) and 235° F.@1300 hours (contact tool). Temperatures measured with the wall-contact tool were approximately 50° F. higher than corresponding temperatures measured with the AMS tool. Temperatures measured with a maximum recording thermometer, run concurrently with the AMS tool, also showed peak temperatures consistent with those obtained with the AMS tool. The data clearly indicate significant differences in temperature measurements resulting from slow response times of the AMS and maximum recording thermometer tools. The time-lapse contact tool data also show the extent of the transient temperature conditions induced from mud circulation.

The thermally dynamic wellbore conditions often encountered in open and cased-hole logging applications indicate the need for fast responding temperature logging tools. Ideally, stationary measurements can be made in a thermally static wellbore, allowing several minutes at each station to ensure that the temperature tool reaches complete equilibrium. However, it is not economic to make stationary measurements in most logging applications. For instance, in open-hole wells, there is considerable risk of the tool getting stuck which can result in the loss of tool and ultimately require abandonment of the well. Alternatively, using a slow logging speed of less than 600 feet per hour can also be impractical because of limited wireline winch capabilities and high drilling rig costs. More importantly, there are many logging applications in which the wellbore is subject to transient heating and cooling effects that make nearly impossible to obtain realistic temperature profile information using stationary measurements.

In general, fast responding tools are crucial to obtaining reliable and accurate temperature measurements when logging open or cased-hole wells. Unfortunately, because of thermal inertia, temperature logging tools do not respond instantly to changes in environmental temperature. Instead the tool responds in a transient manner, as shown in FIG. 4. The rate at which the tool reaches thermal equilibrium with its surrounding environment depends on the tool design, the wellbore fluid, and the magnitude of the temperature change to which it is exposed. Consequently, running temperature logs at a continuous speed or with insufficient stationary time intervals can cause the tool to thermally "lag" behind actual wellbore temperature changes.

More specifically, the main causes of inconsistency are the temperature sensor characteristics (e.g., accuracy, stability, long-term reliability and response time), the method used to integrate the sensor into the logging tool (e.g., attached to sonde or to side-arm caliper), and the overall mass of the tool. If the sensor is caliper mounted, then the overall tool response will also depend upon how effectively the sensor makes contact with the wellbore wall. In this case, it is necessary to establish a reliable means of monitoring sensor contact quality.

Figure 5:
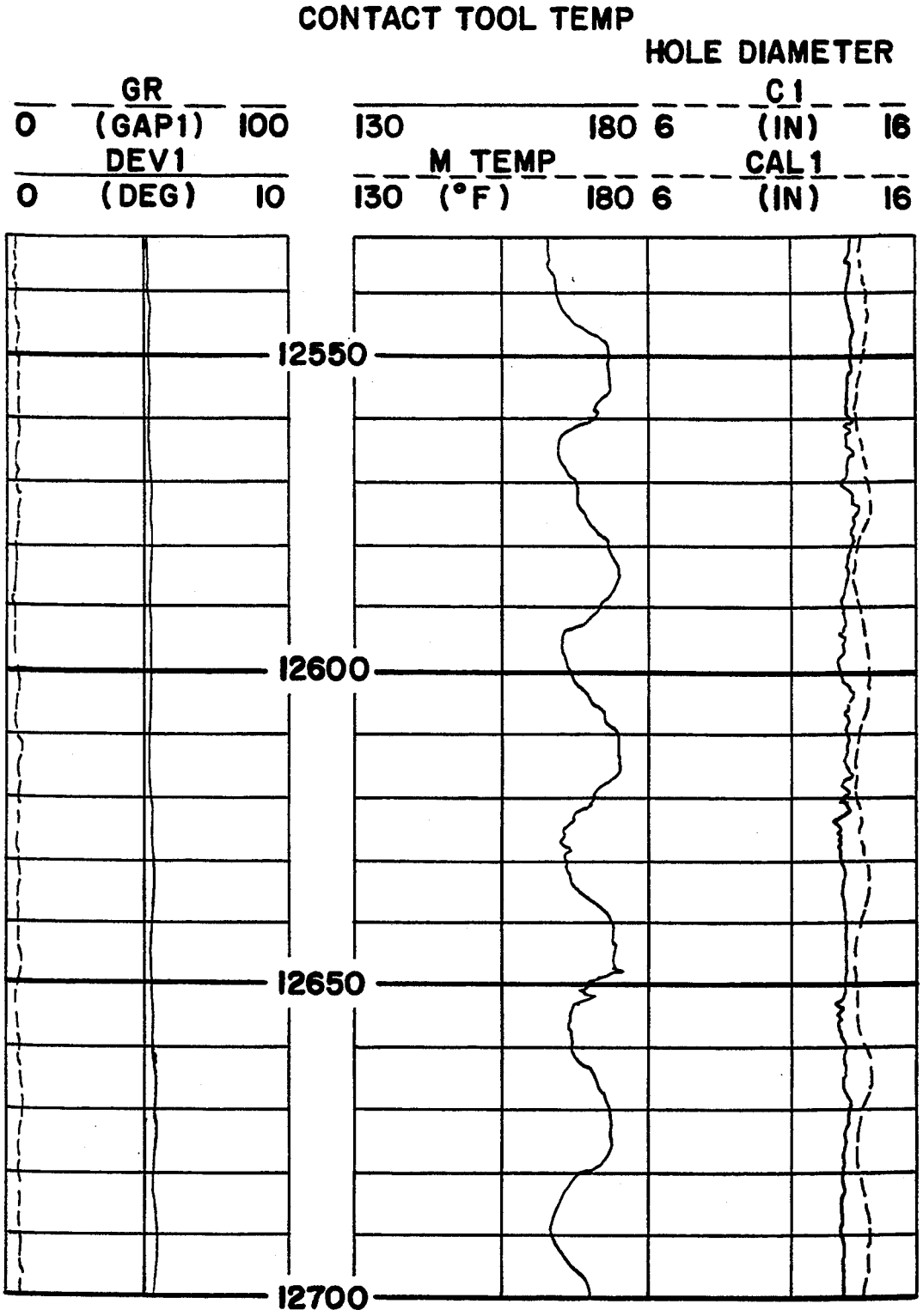
FIG. 5 illustrates the relationship of temperature to wellbore rugosity.

FIG. 5 is a well log that further illustrates the relationship of temperature to wellbore rugosity (i.e., the change in wellbore diameter with depth), when using a pad mounted, wellbore wall-contacting temperature sensor. Comparison of temperature and caliper measurements show unreliability of temperature measurements at locations having an enlarged wellbore diameter and therefore poor sensor contact with the formation. In sections of enlarged wellbore diameter (non-hatched areas), temperature readings are at a minimum value. Comparisons of these low values with values derived from a sonde mounted temperature sensor suggest that they are close to the temperature of the drilling mud. In sections of nearly in-gage borehole (hatched area in FIG. 5), temperature readings are higher and are interpreted to reflect the true transient temperature of the formation. In some sections of the borehole, however, the relationship between the caliper and temperature measurements is less clear. Although the borehole appears to be in-gage, the temperature readings appear close to mud, suggesting that poor borehole contact was degrading the temperature readings. In this case, it is possible that the rugosity of the borehole surface is of a higher frequency than the mechanical and sampling rate limits of the available calipers. Alternatively, the tool may have a large quantity of mud solids attached to the sensor preventing good formation contact. Therefore, a method and apparatus for taking wellbore wall contact efficiency into consideration is greatly needed.

In another embodiment of the tool, in which the first and second heat flux sensors are electronically compared to form a differential heat flux measurement, the sensitivity of the device to poor borehole contact is significantly increased. By significantly increased, we mean an increase in sensitivity by at least one order of magnitude. This results from not having to rely on a single, absolute measurement.

In yet another embodiment of the tool, a single heat flux sensor (sensor number one) can be used without additional sensors (i.e., sensor two) to determine poor borehole contact, by making the assumption that when the observed heat flux is minimal, or corresponds to a value or range of values interpreted to be that of heat flow between the heat flux sensor and the mud, these values form a baseline indicating poor contact between the sensor and the borehole wall. Deviations in heat flow from this baseline would be interpreted as conditions of improved contact between the sensor and the borehole wall.

The inventive method and apparatus provides more accurate temperature measurements than the existing methods. As illustrated in FIG. 4, heat flux (q) is proportional to $$q \propto \frac{T_2 - T_1}{t_2 - t_1}$$

$T_1$ is the temperature measured using the second temperature sensor 21, and can be determined at any given time. The objective is to determine $T_2$ (wellbore wall temperature), as illustrated in FIG. 4, $\tau$ is the time at which the temperature reaches 63.2% of final, equilibrated temperature. Therefore, q gets very small, (as known to those of ordinary skill in the art), as thermal equilibrium is reached. q response is much faster than temperature sensor responses.

Heat flux comparisons can therefore be referenced to a known temperature to derive actual wellbore wall temperature. As $T_1$ and $T_2$ approach each other, first sensor contact quality improves. Heat flux sensors provide this information.

Figure 6:
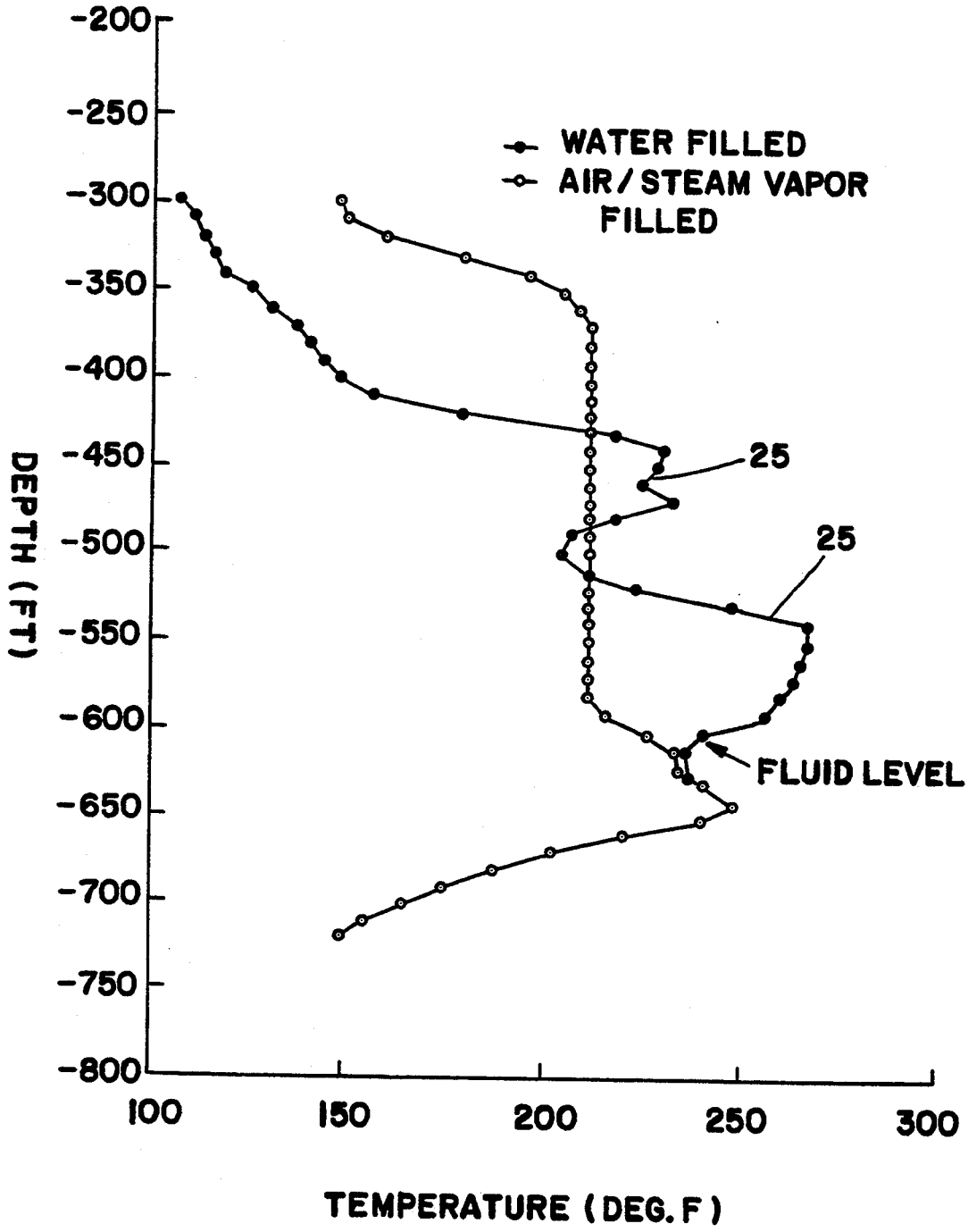
FIG. 6 illustrates the effects of heat-breakthrough to a production wellbore.

In another embodiment of the invention, the location in a production wellbore of "heat breakthrough" (e.g., when steam flows through the formation, channeling through high permeability zones or overriding the top of the target interval, and breaks through to the production wellbore) can be determined. Existing temperature logging methods record the wellbore wall temperature which may or may not be useful in determining the location of heat breakthrough along the well. Temperature profiles can be affected by the fluid in the wellbore as illustrated in FIG. 6. For example, if the wellbore is filled with liquid, so that steam vapor is not present, then anomalously large increases in the wall temperature profile can be used to identify locations of heat breakthrough 25. However, if steam vapor is present in the wellbore, then heat breakthrough zones will be masked or "smeared" and wall temperatures will only reflect saturated steam vapor temperatures within the wellbore. Conversely, heat flux sensors respond to heat flow at the wellbore wall and are not affected by temperature smearing caused by fluids within the wellbore. Therefore, using the inventive method and apparatus, heat flux measurements provide a more reliable means identifying heat breakthrough locations in wellbores.

The inventive method and apparatus may be used in other, additional applications. Applications exist in hydrocarbon exploration, field development and exploitation, and wellbore engineering. One application is the modeling of hydrocarbon maturation (e.g., gas and oil generation) in sedimentary basins using steady-state temperatures measured in open wellbores shortly after drilling. Another application is the monitoring of fluid movement in steamflooded reservoirs using time-lapsed temperature profiling in cased wellbores. Transient and steady-state temperatures are also used in the interpretation of other types of open and cased-hole logging measurements. Transient temperatures are used during drilling and completion operations to design cement jobs, to monitor the effectiveness of cement curing or setting after the well has been cased, and to design and evaluate well workover and stimulation jobs. In each of these applications it is important to obtain reliable and accurate wellbore temperatures under steady-state or transient wellbore conditions.

While a preferred embodiment of the invention has been described and illustrated, it should be apparent that many modifications can be made thereto without departing from the spirit or scope of the invention. Accordingly, the invention is not limited by the foregoing description, but is only limited by the scope of the claims appended hereto.

What is claimed is:

1. An apparatus for monitoring the temperature in a wellbore comprising a first heat flux and temperature sensor attached to a means for contacting said first sensor against the wall of said wellbore so that the heat flux between said sensor and said wellbore is measured, and a means for determining the diameter of said wellbore.

2. The apparatus of claim 1 further comprising at lest one second heat flux and temperature sensor that is maintained in contact with the drilling fluid in said wellbore and that does not contact said wellbore wall.

3. The apparatus of claim 2 further comprising a means for recording the response of said first and second heat flux and temperature sensors to permit a comparison of said responses.

4. The apparatus of claim 2 wherein the number of first sensors is more than one and the number of second sensors is more than one.

5. A method of monitoring the temperature in a wellbore comprising the steps of:

lowering an apparatus into said wellbore to a desired depth, said apparatus comprised of a first heat flux and temperature sensor attached to a means for contacting said first sensor against the wall of said wellbore, and a means for determining the diameter of said wellbore; and moving said apparatus at a nearly constant speed over a selected interval in said wellbore so that the heat flux between said sensor and said wellbore is measured.

6. A method for monitoring the temperature in a wellbore comprising the steps of:

lowering an apparatus into said wellbore to a desired depth, said apparatus comprised of at least first heat flux and temperature sensor attached to a means for contacting said first sensor against the wall of said wellbore, a second heat flux and temperature sensor that is maintained in contact with the drilling fluid in said wellbore and that does not contact said wellbore wall, and a means for determining the diameter of said wellbore; and moving said apparatus at a nearly constant speed over a selected interval in said wellbore.

7. The method of claim 6 further comprising the step of recording the responses of said first and second heat flux and temperature sensors to permit a comparison thereof.

8. The method of claim 6 wherein the number of first sensors is more than one and the number of second sensors is more than one.

9. The method of claim 8 further comprising the step of comparing said responses of said sensors to determine when said first sensors were in contact with said wall of said wellbore.

10. The method of claim 9 further comprising the step of determining the thermal time constant of said apparatus.

11. The method of claim 9 further comprising the step of determining whether said first and second sensors are in thermal equilibrium.

12. The method of claim 9 further comprising the step of determining the depths at which steam flows preferentially through a geologic formation in said wellbore.

* * * * *